United States Patent [19]

Call

[11] 4,328,402

[45] May 4, 1982

[54] SENSING SWITCH FOR DETECTING A DOCUMENT

[75] Inventor: Daniel D. Call, Glenview, Ill.

[73] Assignee: Bell & Howell Company, Chicago, Ill.

[21] Appl. No.: 70,279

[22] Filed: Aug. 27, 1979

[51] Int. Cl.[3] ..... H01H 3/16

[52] U.S. Cl. ..... 200/61.41; 200/61.42; 335/205

[58] Field of Search ..... 200/61.41, 61.42, 46; 235/445-448; 335/205

[56] References Cited

U.S. PATENT DOCUMENTS

| | | | |
|---|---|---|---|
| 2,475,307 | 7/1949 | Bravel et al. | 235/446 |
| 3,202,779 | 8/1965 | Call | 200/61.42 |
| 3,246,526 | 4/1966 | Dollheimer et al. | 200/61.41 X |
| 3,461,255 | 8/1969 | Call | 200/61.42 |
| 3,684,845 | 8/1972 | Palmer | 200/61.41 |
| 3,912,890 | 10/1975 | Call | 200/61.42 X |

*Primary Examiner*—J. V. Truhe
*Assistant Examiner*—Morris Ginsburg
*Attorney, Agent, or Firm*—Alan B. Samlan; J. Warren Whitesel

[57] ABSTRACT

A document switch senses the movement of a plurality of cards, or the like, as they pass through a path of travel. A pivotable assembly has first and second pivoted arm members including a sensing arm mounted on a pivotable element. In its initial position, the sensing arm projects into the path of card travel. When the card appears, the sensing arm is moved out of its initial position, and a contact mounted on the assembly opens to sense an engagement of the arm with a card. Continued travel of the card moves the arm against a stop which withdraws it from the path of travel and resilient means brings the sensing arm into engagement with the underside of the card. A leaf spring presses against the card to retain it in a guide plane as it travels away from the sensing arm and into the nip of take-up rollers.

5 Claims, 5 Drawing Figures

SENSING SWITCH FOR DETECTING A DOCUMENT

BACKGROUND OF THE INVENTION

This invention relates to sensing switches used in the general field of data processing and, more particularly, to switches for automatically sensing card-like forms such as checks, computer cards, or similar documents.

It is desirable to process a continuous stream of such documents and, therefore, it is desirable that a sensing switch be provided to count the documents. For example, the documents may be counted prior to their being photographed, endorsed, or otherwise processed.

The present invention relates to improvements in switches of the type exemplified in and protected by my prior U.S. Pat. Nos. 3,202,779, 3,461,255 and 3,912,890. All of the above-mentioned patents disclose sensing switches which generate electric signals responsive to a passage of documents as they move through a path of travel.

Two of these patents used a wheel which had three fingers or "flippers" which were equally spaced around the periphery. Each document that passed through the sensing area engaged the finger or flipper and indexed the wheel to cause it to move through a 120° rotation. The problem with this type of sensor is that it is large and bulky. At the time, when the wheel sensor was made, miniaturization of equipment was not as important as it is today. Therefore, a large machine did not suffer too many penalties. Today, however, it is very difficult to sell a machine which is larger and more bulky than its competitor.

A third of my prior patents eliminated the wheel and thereby became more compact. However, it also depends upon gravity and, therefore, cannot be used in any orientation except the single one where gravity pulled the parts back to their normal position.

Beyond this, each of the switches in my earlier patents include design consideration which prevented the take-up rollers from being positioned as close to the output of the sensor as is possible with the subject invention. Thus, these closely positioned take-up rollers enable the present sensor to have a greatly reduced tendency to jam, which leads to looser manufacturing tolerances and, therefore, lower cost production. The freedom from jamming is further enhanced by the provision of a resilient guide finger for urging the document to follow a predetermined travel path which better leads into the take-up rollers.

Yet another consideration is the environment in which the sensor operates. As the documents feed through their travel path, lint tends to rub off and to build up a binding accumulation. The mechanical parts tend to bind and become restricted and the electrical contacts tend to become dirty due to the accumulaton of lint.

The invention solves these and similar problems by providing spring-biased actuator arms and by providing reed contacts sealed in glass.

Accordingly, an object of the invention is to provide new and improved document sensors. In this connection, an object is to provide sensors which operate in virtually any physical orientation. Here, an object is to provide a more jam-free operation.

Another object is to provide a more reliable document sensor. Here, an object is to provide a document sensor which is less adversely affected by an accumulation of any lint which may be rubbed off the documents. In particular, an object is to provide sensors which operate sealed contacts.

Still, another object of the invention is to provide highly reliable miniature document sensors.

According to an aspect of the present invention, switches are provided for sensing the passage of documents, such as a card, through an apparatus, especially one used in data processing. The sensing switch comprises an assembly which includes a base portion rigidly mounted on the apparatus and containing normally closed contacts sealed in glass. A linkage assembly mounted on the base portion includes a lower link and an upper link, the upper link serving as a sensing element which is moved by the document. A lower portion of the lower link is pivotally and resiliently mounted on the base portion of the switch. At its upper portion, the lower link has the sensing element pivotally and resiliently mounted thereon. In the initial position of the sensing switch, a toe of the sensing element is positioned to contact edges of documents, such as cards, which are part of a continuous stream of documents moving along a travel path in the apparatus.

Continuous movement of a document along the path drives the lower link of the sensing element away from the base portion, to open the contacts mounted in the base portion, for counting the document. A cam surface engages the sensing element to cause it to drop the arm from its engagement with the leading edge of the card to an engagement with the under surface of the card. Resilient means are provided between the sensing element and the lower link for biasing the sensing element against the under surface of the card, as it continues to move through the travel path. Associated resilient means are mounted on the base portion of the assembly to press the lead edge of the card and to retain it against a guide plate as it moves into the nip of take-up rollers at the output of the sensor.

If two cards enter the travel path in an overlapped relationship, with the upper card preceding the lower card, the arm goes through its cycle of operation for each leading edge thus counting, endorsing, or otherwise processing each of the two documents individually.

BRIEF DESCRIPTION OF THE DRAWINGS

Various other objects and advantages of the present invention are pointed out in the claims appended hereto and forming a part of the present specifications. However, for a better understanding of the invention, its advantages and objects, reference may be had to the attached drawings, and to the following detailed description wherein:

BRIEF DESCRIPTION OF THE PREFERRED EMBODIMENT

The sensing switch of the present invention may be utilized in a machine which counts, photographs, endorses, or otherwise handles documents, such as checks, computer cards, or other objects, which are herein generically called "cards." These cards are placed in any suitable apparatus bin for processing. From that bin, suitable transport drive equipment moves the cards along a path of travel including the sensing switch.

Figure 1:
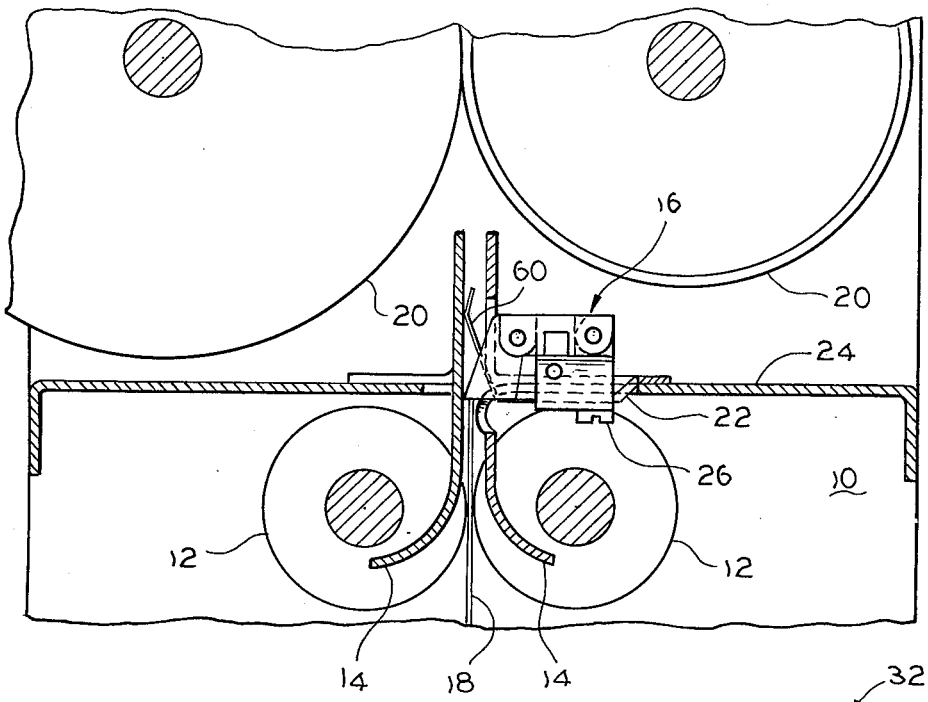
FIG. 1 is a fragmentary side elevation of exemplary apparatus employing the sensing switch of the present invention.

A lower transport system 10 (FIG. 1) comprises a pair of feed rollers 12,12, a pair of guide plates 14,14, which guide the cards one at a time past the inventive sensing switch 16, which counts them. One of the cards 18 is here shown as it first engages the sensing switch 16.

The cards pass into the nip of an upper pair of transport or take-up rollers 20,20 for further processing by any suitable apparatus. The switch 16 is fastened to a bracket 22 which is supported between the lower feed rollers 12,12 and the upper pair of take-up rollers 20,20. Bracket 22 is mounted on a cross plate 24 of the apparatus by means of screw 26.

The switch 16 (FIG. 2) comprises non-magnetic base 28, having integral therewith a pair of upstanding projections 30,30 extending therefrom. A first pivotal sensor arm assembly, in the form of a generally H-shaped member 32, overlies the base 28 with opposite legs 34,34 extending outwardly from a center portion 36. The legs 34,34 and projections 30,30 cooperate to form a hinge, with a hinge pin 38 forming a pivot about which the first H-shaped sensor arm member 32 may swing. A hair spring 40 surrounds the hinge pin 38 and biases the first H-shaped sensor arm member 32 to normally lie flat upon base 28, in the general position seen in FIG. 2.

Figure 2:
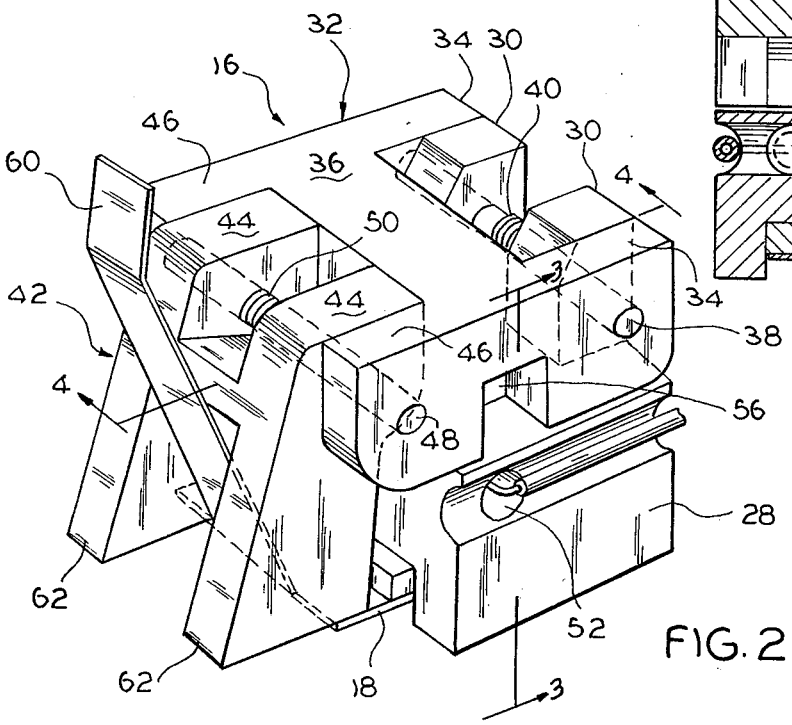
FIG. 2 is a perspective view of the sensing switch of the present invention.
Figure 4:
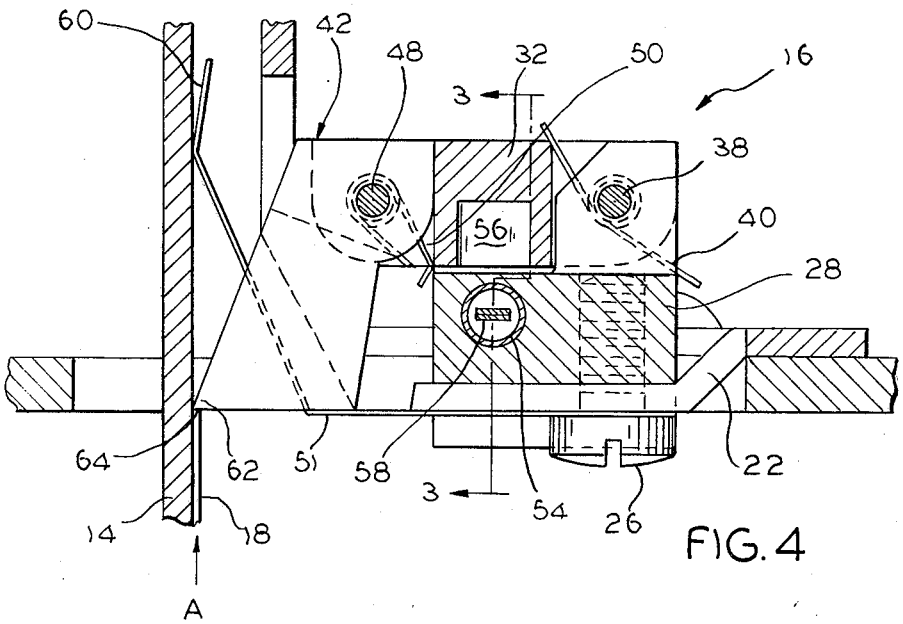
FIG. 4 is a vertical sectional, stop motion view of the sensing switch, taken along line 4—4 of FIG. 2, wherein the sensing elements of the invention are shown in their initial positions, as a document is first sensed during operating cycle.

A second pivotal assembly, in the general form of an H-shaped sensor arm member 42 includes a pair of outwardly extending arms 44,44 which cooperate with legs 46,46 to form a hinge pivoting about a hinge pin 48. A second hair spring 50 encircles the hinge pin 48 and normally biases the first and second pivotal sensor arm members 32,42 to a folded or generally L-shaped configuration as seen in FIGS. 2 and 4. When in the L-shaped configuration, flared toe ends of the H-shaped arm member 42 rests on a floor-like member formed by a wide part 51 of a leaf spring which is held in place by the screw 26.

Figure 3:
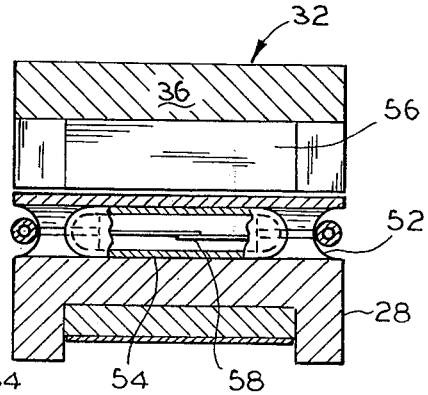
FIG. 3 is a horizontal, sectional view of the sensing switch, taken along lines 3—3 of FIGS. 2 and 4 showing the glass reed switching mechanism which is employed in the present invention.

A glass reed contact assembly 54 (FIG. 3) is inserted into a hole 52 in the base member 28. As it pivots on the hinge pin 38, the first pivotal sensor arm member 32 carries a magnet 56 into and out of magnetic coupling with the glass reed switch 54. Since the base 28 is non-magnetic material, the switch contacts 58 are closed when the pivotal assembly 32 is lying on the base (FIG. 4) and opened when the assembly swings away from the base (FIG. 5).

The sensor switch assembly 16 is completed by a leaf spring 60 which is an integral extension of the floor member 51 that is attached to the bottom of the base 28. The leaf spring 60 is inclined to extend toward an opposing abutment or guide plate 14 for guiding the card as it moves through the travel path. This leaf spring 60 holds the cards 18 in a stable position, leading directly into the nip of take-up rollers 20,20.

Figure 5:
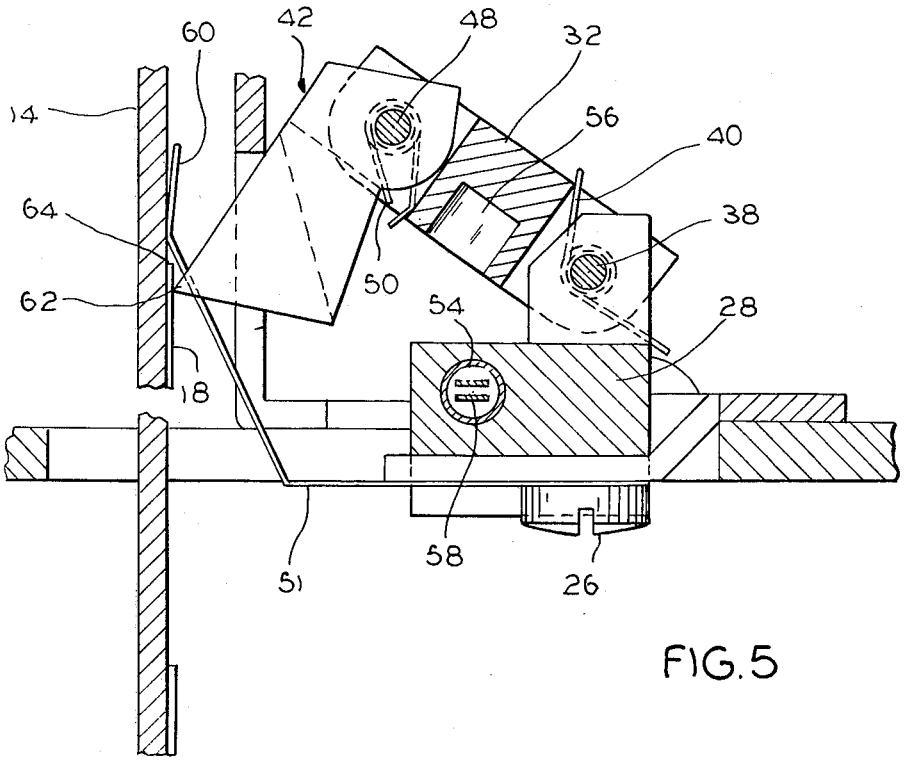
FIG. 5 is a second stop motion view which is similar to FIG. 4, showing the sensor element as it is held against the under surface of the document.

The document-sensing operation of the switch is seen in the two stop motion views of FIGS. 4 and 5. In FIG. 4, the two sensor arm members 32,42 of sensor switch 16 are held in their normal L-shaped positions by means of the hair springs 40,50. The toe 62 of the second sensor arm member 42 is resting on floor 51 and against a far side guide plate 14. The card 18 is seen advancing in direction A toward the toe 62 of the arm 42.

As the lower feed or transport rollers 12 push the card 18 toward sensor switch 16, the leading edge 64 engages toe 62 of the second sensor arm member 42 and pushes it upwardly (Direction A), against the bias of the hair springs 40,50. As the second sensor arm member 42 moves upwardly, it lifts the pivot point formed by hinge pin 48, and thereby swings the first arm member 32 against the bias of spring 40.

Eventually, the second arm member 42 swings far enough to enable the leading edge 64 of card 18 to slip under the toe 62 (FIG. 5). As the card 18 travels on, it passes under the leaf spring 60 which holds it flat against the guide plate 14. During the passage of card 18 under the toe 62, the first arm member 32 is held continuously in the raised position, as seen in FIG. 5. At this time, the magnet 56 is removed from the switch 54 by a distance which is sufficient to hold open the contacts 58. After the card 18 has cleared the toe 62 of the second sensor arm member 42, the hair springs 40,50 push the sensor arm members 32,42 back to their normal position (FIG. 4). At that time, the magnet 56 is again positioned in proximity with the contacts 58, which close. The next oncoming card will cause the arm motion to repeat, with a resulting opening and closing of the contacts 58.

In the event that card 18 and the next oncoming card overlap when fed, the switch will still operate. It is required that there be sufficient distance between the leading edges of card 18 and the oncoming card to allow the toe 62 of sensor arm 42 to reset or drop down far enough to allow the contacts 58 to reclose. Thus, a signal will be provided for each card.

The opening and reclosing of the contacts 58 provide a signal which may be used to control any suitable device, such as an endorsing machine, a data processing machine, a punched card reader, or the like.

Those who are skilled in the art will readily perceive how to modify the system. Therefore, the appended claims are to be construed to cover all equivalent structures which fall within the true scope and spirit of the invention.

I claim:

1. A document-sensing device comprising an articulated generally straight pair of elongated sensor arm members pivotally interconnected with each other near ends thereof, spring bias means for normally urging said pair of arm members into an initial generally L-shaped configuration with a toe of the "L" being located in the path of an oncoming card, pivot means rotatably supporting an end of the "L" opposite the toe thereof for mounting one of the sensor arm members on a base structure, said spring bias means being located at each of the pivots for urging said arm members to said initial configuration, the other of said arm members being shaped and proportioned relative to said one arm member to enable said pair of arm members to pivot and form a mutual angle which is more acute than an angle formed by said initial "L" shape, means responsive to passage of a document by the toe of said "L" shape for urging said arm members to pivot on both of said pivots against the urging of said spring bias, and means for giving an electrical signal each time that said arm members pivot responsive to a passage of a document.

2. The document-sensing device of claim 1 and resilient means for holding said document against an abutment guide plate opposite the toe of said L-shaped articulated arm members, said spring bias means urging the toe of said L-shaped arm members against said abutment guide plate whereby, as said document moves past said toe, it rides over the leading edge of the sensed document.

3. The document-sensing device of claim 2 wherein said electrical signal means comprises a magnet carried by one of said arm members and reed contact means positioned on said base structure and in the field of said magnet when said arm members are in said normal L-shaped configuration.

4. The document-sensing device of claim 2 wherein the toe terminates in a flared end on said other of said arm members and floor means generally perpendicular to said abutment guide plate, said floor means receiving and supporting said flared end when said L-shaped arm member is urged by said spring bias means into an initial position.

5. A sensor for electrically sensing the presence of documents as they move through a path of travel, said sensor comprising a fixed base means rigidly mounted adjacent the path of travel, first rotatable means having first end pivotally mounted on the base means and biased by spring means to normally rest on said base means, second rotatable means pivotally mounted on a second end of the first rotatable means, resilient means interposed between said first and second rotatable means for retaining said first and second rotatable means in an initial position wherein the second rotatable means is in a position which protrudes into said path for making an abutting engagement with a leading edge of a document travelling through said path, the movement of said second rotatable means being opposed by said resilient means as said second rotatable means is forced out of said abutting engagement with the document, additional resilient means controlling the position of the leading edge of the document for guiding the document away from the sensor through said path of travel and into take-up roller means, and control means actuated by movement of said first and second rotatable means for performing a switching function when said rotatable means are moved away from said initial position.

* * * * *